US012110664B2

(12) United States Patent
Kamado et al.

(10) Patent No.: US 12,110,664 B2
(45) Date of Patent: Oct. 8, 2024

(54) DISPLAY SYSTEM, PROGRAM, AND METHOD FOR CONTROLLING DISPLAY SYSTEM FOR DISPLAYING AN INCLINATION OF AN EXCAVATION TOOL

(71) Applicant: KOMATSU LTD., Tokyo (JP)

(72) Inventors: Mitsuhiko Kamado, Tokyo (JP); Akihiro Kageyama, Tokyo (JP); Hayato Hisa, Tokyo (JP); Toru Obara, Kamakura (JP)

(73) Assignee: KOMATSU LTD., Tokyo (JP)

( * ) Notice: Subject to any disclaimer, the term of this patent is extended or adjusted under 35 U.S.C. 154(b) by 118 days.

(21) Appl. No.: 17/910,482

(22) PCT Filed: Mar. 17, 2021

(86) PCT No.: PCT/JP2021/010824

§ 371 (c)(1),
(2) Date: Sep. 9, 2022

(87) PCT Pub. No.: WO2021/200157

PCT Pub. Date: Oct. 7, 2021

(65) Prior Publication Data

US 2023/0160181 A1 May 25, 2023

(30) Foreign Application Priority Data

Apr. 3, 2020 (JP) ..... 2020-067662

(51) Int. Cl.

| | |
|---|---|
| ***E02F 9/26*** | (2006.01) |
| ***E02F 3/43*** | (2006.01) |
| ***E02F 9/20*** | (2006.01) |
| ***G06T 11/00*** | (2006.01) |

(52) U.S. Cl.
CPC ..... *E02F 9/261* (2013.01); *E02F 9/264* (2013.01)

(58) Field of Classification Search
CPC . G06T 11/001; G06T 3/40; G06T 3/60; G06T 2200/24; G01C 9/04–06; E02F 9/20; E02F 9/26; E02F 9/261–264; E02F 9/205; E02F 3/32; E02F 3/435; G06F 3/04847; G06F 3/0482; B60K 2360/171; B60K 35/00; B60K 35/22; B60K 35/28
See application file for complete search history.

(56) References Cited

U.S. PATENT DOCUMENTS

| | | | | |
|---|---|---|---|---|
| 10,900,201 | B2 * | 1/2021 | Shintani | G01C 9/04 |
| 2015/0218781 | A1 | 8/2015 | Nomura et al. | |
| 2016/0251834 | A1 | 9/2016 | Arimatsu et al. | |
| 2017/0175362 | A1 * | 6/2017 | Iwanaga | G01S 19/43 |

(Continued)

FOREIGN PATENT DOCUMENTS

| | | | |
|---|---|---|---|
| CN | 105992851 | A | 10/2016 |
| CN | 107208404 | A | 9/2017 |

(Continued)

*Primary Examiner* — Wesner Sajous
(74) *Attorney, Agent, or Firm* — Faegre Drinker Biddle & Reath LLP

(57) ABSTRACT

A display system includes a display and a controller. The controller causes the display to display a third figure representing a relative relationship between a first figure indicating a direction of a working implement of a working machine and a second figure indicating a direction of a target topography from the working machine.

16 Claims, 10 Drawing Sheets

(56) References Cited

U.S. PATENT DOCUMENTS

| | | | | |
|---|---|---|---|---|
| 2018/0030694 | A1* | 2/2018 | Kanari | E02F 9/264 |
| 2018/0167588 | A1* | 6/2018 | Izumikawa | E02F 3/40 |
| 2019/0218749 | A1* | 7/2019 | Hiromatsu | E02F 9/2045 |
| 2020/0165798 | A1* | 5/2020 | Nishi | E02F 9/264 |
| 2020/0299924 | A1 | 9/2020 | Kurokawa et al. | |
| 2021/0131075 | A1* | 5/2021 | Kumakura | E02F 9/264 |
| 2021/0331590 | A1* | 10/2021 | Nishimura | B60K 35/00 |

FOREIGN PATENT DOCUMENTS

| | | | |
|---|---|---|---|
| CN | 110352280 | A | 10/2019 |
| CN | 110905037 | A | 3/2020 |
| JP | 2016-186210 | A | 10/2016 |
| JP | 2019-105160 | A | 6/2019 |
| JP | 2019-157600 | A | 9/2019 |
| KR | 10-2015-0038619 | A | 4/2015 |
| KR | 10-2016-0002730 | A | 1/2016 |
| WO | WO-2015/030266 | A1 | 3/2015 |
| WO | WO-2019/031509 | A1 | 2/2019 |
| WO | WO-2019/124549 | A1 | 6/2019 |

* cited by examiner

DISPLAY SYSTEM, PROGRAM, AND METHOD FOR CONTROLLING DISPLAY SYSTEM FOR DISPLAYING AN INCLINATION OF AN EXCAVATION TOOL

TECHNICAL FIELD

The present disclosure relates to a display system, a program, and a display control method.

BACKGROUND ART

When work is performed by a working machine such as a hydraulic excavator, an operator needs to cause the working machine (particularly, a working implement of the working machine) to face a target topography (target construction surface). In order to support such an operation of the operator, the working machine that displays a facing compass is known, for example, as disclosed in Japanese Patent Laying-Open No. 2019-105160 (PTL 1).

The working machine of PTL 1 displays posture information such as a picture or an icon, which guides a facing direction with respect to the target topography and a direction in which the hydraulic excavator should be turned, on a display as the facing compass.

CITATION LIST

Patent Literature

PTL 1: Japanese Patent Laying-Open No. 2019-105160

SUMMARY OF INVENTION

Technical Problem

A relationship between the direction of the working implement of the working machine and the direction of the target topography from the working machine is desirably provided in a visually more understandable manner in order to support the operator of the working machine.

An object of the present disclosure is to provide a display system, a program, and a method for controlling the display system capable of providing the relationship between the direction of the working implement of the working machine and the direction of the target topography in the visually more understandable manner.

Solution to Problem

A display system according to one aspect of the present disclosure includes a display and a controller. The controller causes the display to display a third figure representing a relative relationship between a first figure and a second figure, the first FIG. indicating a direction of a working implement of a working machine, and the second figure indicating a direction of a target topography from the working machine.

A display system according to another aspect of the present disclosure includes a display and a controller. The controller causes the display to display an image indicating a working machine, a straight line extended from a working implement of the working machine, and a straight line connecting the image indicating the working machine and an image indicating a target topography in top view of the working machine.

A program according to still another aspect of the present disclosure that causes a processor of a controller to execute: generating a first figure indicating a direction of a working implement of a working machine; generating a second figure indicating a direction of a target topography from the working machine; generating a third figure representing a relative relationship between the first figure and the second figure; and causing a display to display the third figure A display control method according to yet another aspect of the present disclosure, the display control method includes the following steps.

A first figure indicating a direction of a working implement of a working machine is generated. A second figure indicating a direction of a target topography from the working machine is generated. A third figure representing a relative relationship between the first figure and the second figure is generated. The third FIG. is displayed on a display.

Advantageous Effects of Invention

According to the present disclosure, the display system, the program, and the display system control method capable of providing the relationship between the direction of the working implement of the working machine and the direction of the target topography in the visually more understandable manner.

DESCRIPTION OF EMBODIMENT

Figure 1:
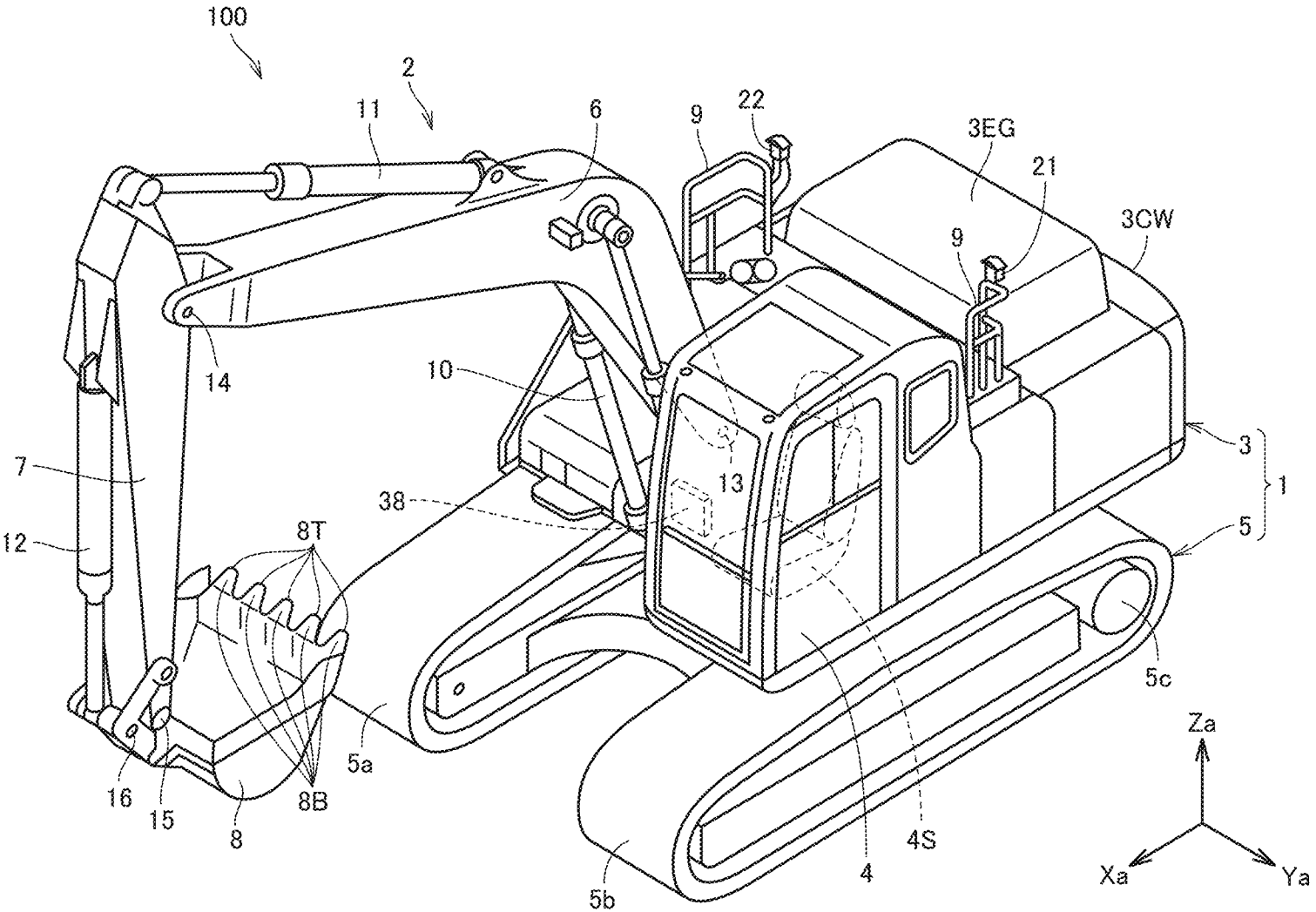
FIG. 1 is a perspective view illustrating a configuration of a hydraulic excavator as an example of a working machine according to an embodiment.

Hereinafter, an embodiment of the present disclosure will be described in detail with reference to the drawings. In the specification and the drawings, the same components or corresponding components are denoted by the same reference numerals, and redundant description will not be repeated. In the drawings, the configuration may be omitted or simplified for convenience of description. In addition, at least a part of the embodiment and each modification may be arbitrarily combined with each other.

<Overall Configuration of Working Machine>

With reference to FIG. 1, a configuration of a hydraulic excavator as an example of a working machine to which the idea of the present disclosure can be applied will be described. The present disclosure is also applicable to a working machine having an excavation tool other than the following hydraulic excavator.

In the following description, a front-rear direction is a front-rear direction of the operator seated on a driver's seat 4S in an operator cab 4 in FIG. 1. A direction facing the operator seated on driver's seat 4S is a forward direction, and a direction behind the operator seated on driver's seat 4S is a backward direction. A left-right direction is a left-right direction of the operator seated on driver's seat 4S. A right side and a left side when the operator sits on driver's seat 4S faces a front are a right direction and a left direction, respectively. A vertical direction is a direction orthogonal to a plane defined by the front-back direction and the left-right direction. In the vertical direction, a side on which the ground exists is a lower side, and a side on which the sky exists is an upper side.

Figure 2:
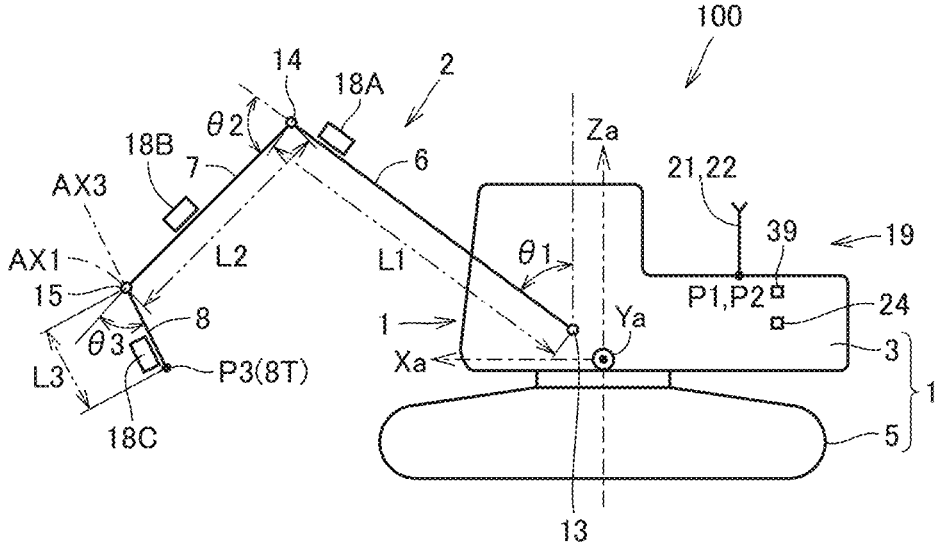
FIG. 2 is a side view of the hydraulic excavator.
Figure 3:
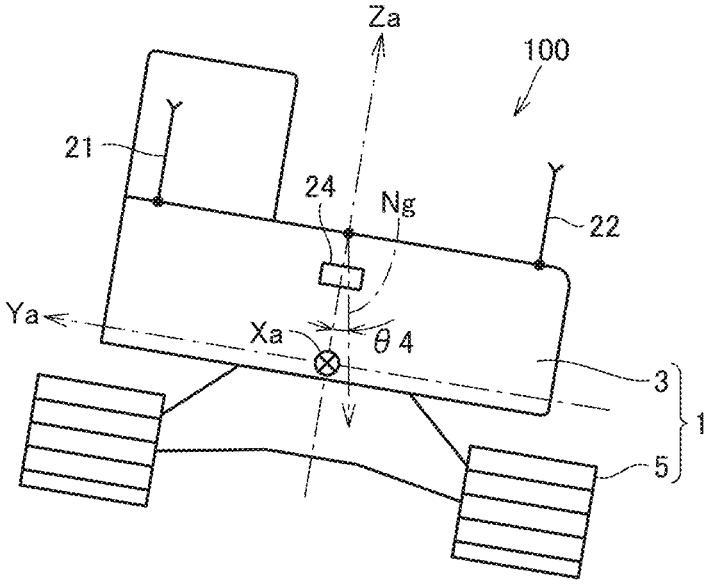
FIG. 3 is a rear view of the hydraulic excavator.

FIG. 1 is a perspective view illustrating the configuration of the hydraulic excavator as an example of the working machine according to an embodiment. FIGS. 2 and 3 are a side view and a rear view of the hydraulic excavator.

As illustrated in FIG. 1, a hydraulic excavator 100 as the working machine in the embodiment includes a machine body 1 and a working implement 2 as a main body. Machine body 1 includes a revolving body 3 and a traveling device 5. Revolving body 3 accommodates devices such as a power generator and a hydraulic pump (not illustrated) in a machine chamber 3EG. Machine chamber 3EG is disposed on a rear end side of revolving body 3.

For example, hydraulic excavator 100 includes an internal combustion engine such as a diesel engine as a power generation device, but hydraulic excavator 100 is not limited to such the internal combustion engine. For example, hydraulic excavator 100 may include what is called a hybrid type power generation device in which the internal combustion engine, a generator motor, and a power storage device are combined.

Revolving body 3 includes operator cab 4. Operator cab 4 is mounted on a front end side of revolving body 3. Operator cab 4 is disposed on a side opposite to a side where machine chamber 3EG is disposed. A display input device 38 and an operation device 25 are disposed in operator cab 4 (see FIG. 4). These will be described later.

Traveling device 5 is disposed below revolving body 3. Traveling device 5 includes crawler belts 5*a*, 5*b*. Traveling device 5 causes hydraulic excavator 100 to travel by a hydraulic motor 5*c* rotationally driving crawler belts 5*a*, 5*b*. Hydraulic excavator 100 may have tires instead of crawler belts 5*a*, 5*b*, or may be a wheel type hydraulic excavator.

A handrail 9 is provided on revolving body 3. Two GNSS antennas 21, 22 for real time kinematic-global navigation satellite systems (RTK-GNSS) are detachably attached to handrail 9.

For example, GNSS antennas 21, 22 are installed at a certain distance from each other along an axis parallel to a Ya-axis of a machine body coordinate system [Xa, Ya, Za]. GNSS antennas 21, 22 may be installed at a certain distance from each other along the axis parallel to an Xa-axis of machine body coordinate system [Xa, Ya, Za].

GNSS antennas 21, 22 are preferably installed at positions as far away from each other as possible from the viewpoint of improving detection accuracy of the current position of hydraulic excavator 100. In addition, GNSS antennas 21, 22 are preferably installed at positions that do not obstruct a field of view of the operator as much as possible. GNSS antennas 21, 22 may be installed on revolving body 3 and behind a counterweight 3CW or operator cab 4.

Working implement 2 is attached to a lateral side of operator cab 4 of revolving body 3. Working implement 2 includes a boom 6, an arm 7, a bucket 8, a boom cylinder 10, an arm cylinder 11, and a bucket cylinder 12. A base end of boom 6 is rotatably attached to the front of machine body 1 through a boom pin 13. A base end of arm 7 is rotatably attached to a tip of boom 6 through an arm pin 14. Bucket 8 is attached to the distal end of arm 7 through a bucket pin 15.

Bucket 8 includes a plurality of blades 8B. The plurality of blades 8B are attached to an end of bucket 8 on the side opposite to the side on which bucket pin 15 is attached. The plurality of blades 8B are attached to the end of bucket 8 farthest from the side to which bucket pin 15 is attached. The plurality of blades 8B are arrayed in a row in the direction parallel to bucket pin 15. Blade edge 8T is the tip of blade 8B. Blade edge 8T is the tip of bucket 8 at which working implement 2 generates excavation force. The direction parallel to a straight line connecting the plurality of blade edges 8T is a width direction of bucket 8. The width direction of bucket 8 is matched with the width direction of revolving body 3, namely, the left-right direction of revolving body 3.

Bucket 8 is coupled to bucket cylinder 12 through a pin 16. Bucket cylinder 12 expands and contracts to rotate bucket 8. Bucket 8 rotates about an axis orthogonal to the extending direction of arm 7. Boom pin 13, arm pin 14, and bucket pin 15 are disposed in a positional relationship parallel to each other. That is, center axes of the pins are parallel to each other.

Each of boom cylinder 10, arm cylinder 11, and bucket cylinder 12 is a hydraulic cylinder. Each of boom cylinder 10, arm cylinder 11, and bucket cylinder 12 operates by adjusting the expansion and contraction and speed according to pressure or a flow rate of a hydraulic oil.

Boom cylinder 10 operates boom 6, and vertically rotates boom 6 about the center axis of boom pin 13. Arm cylinder 11 operates arm 7, and rotates arm 7 about the center axis of arm pin 14. Bucket cylinder 12 operates bucket 8, and rotates bucket 8 about the center axis of bucket pin 15.

The excavation tool of the hydraulic excavator 100 is not limited to the bucket 8, but may be another excavation tool such as a breaker.

As illustrated in FIG. 2, a length of boom 6 (a length between boom pin 13 and arm pin 14) is L1. The length of arm 7 (the length from the center axis of arm pin 14 to a center axis AX1 of bucket pin 15) is L2. The length of bucket 8 (the length from center axis AX1 of bucket pin 15 to blade edge 8T) is L3. The length of bucket 8 is the length along an axis AX3 orthogonal to center axis AX1 of bucket pin 15 and passing through blade edge 8T of bucket 8.

An inertial measurement unit (IMU) 18A is disposed on boom 6. An IMU 18B is disposed in arm 7. An IMU 18C is disposed in bucket 8. Each of IMUs 18A, 18B, 18C is a working implement posture sensor that detects a posture of working implement 2. Each of IMUs 18A, 18B, 18C detects a triaxial angle (or angular velocity) and acceleration.

The postures of boom 6, arm 7, and bucket 8 can be detected from the triaxial angles (or angular velocities) and accelerations detected by IMUs 18A, 18B, 18C. Specifically, an inclination angle θ1 of boom 6 with respect to the Za-axis of the machine body coordinate system described later can be calculated from the triaxial angle (or angular velocity) and acceleration detected by IMU 18A. An inclination angle θ2 of arm 7 with respect to boom 6 can be calculated from the triaxial angle (or angular velocity) and acceleration detected by IMU 18B. An inclination angle θ3 of bucket 8 with respect to arm 7 can be calculated from the triaxial angle (or angular velocity) and acceleration detected by IMU 18C.

The working implement posture sensor is not limited to the IMU, but may be a stroke sensor, a potentiometer, an imaging device, or the like. The working implement posture sensors may be hydraulic sensors 37SBM, 37SBK, 37SAM in FIG. 4.

Machine body 1 includes a position detector 19. Position detector 19 detects the current position of hydraulic excavator 100. Position detector 19 includes GNSS antennas 21, 22, an inclination angle sensor 24, and a controller 39. Position detector 19 may include a three-dimensional position sensor.

Revolving body 3 and working implement 2 rotate with respect to traveling device 5 about a predetermined revolving center axis. Machine body coordinate system [Xa, Ya, Za] is a coordinate system of machine body 1. In the embodiment, in machine body coordinate system [Xa, Ya, Za], a revolving center axis of working implement 2 or the like is defined as the Za-axis, an axis orthogonal to the Za-axis and parallel to an operation plane of working implement 2 is defined as the Xa-axis, and an axis orthogonal to the Za-axis and the Xa-axis is defined as the Ya-axis. For example, the operation plane of working implement 2 is a plane orthogonal to boom pin 13. The Xa-axis corresponds to the front-rear direction of revolving body 3, and the Ya-axis corresponds to the width direction of revolving body 3.

A signal corresponding to a GNSS radio wave received by each of antennas 21, 22 is input to controller 39. GNSS antenna 21 receives reference position data P1 indicating an own installation position from a positioning satellite. GNSS antenna 22 receives reference position data P2 indicating the own installation position from the positioning satellite. For example, GNSS antennas 21, 22 receive reference position data P1, P2 at a cycle of 10 Hz. Reference position data P1, P2 are information about the position where the GNSS antenna is installed. Each time GNSS antennas 21, 22 receive reference position data P1, P2, GNSS antennas 21, 22 output reference position data P1, P2 to controller 39.

As illustrated in FIG. 3, inclination angle sensor 24 is attached to revolving body 3. Inclination angle sensor 24 detects an inclination angle θ4 of the width direction of machine body 1 with respect to the direction in which gravity acts, namely, vertical direction Ng. For example, inclination angle sensor 24 may be the IMU.

IMUs 18A, 18B, 18C, GNSS antennas 21, 22, inclination angle sensor 24, display input device 38, and controller 39 may be added to hydraulic excavator 100 as a retrofitted kit. Hereinafter, the hydraulic excavator equipped with the retrofitted kit is referred to as the hydraulic excavator 100, and the hydraulic excavator not equipped with the retrofitted kit is referred to as a hydraulic excavator 100*a*.

<Display System>

Figure 4:
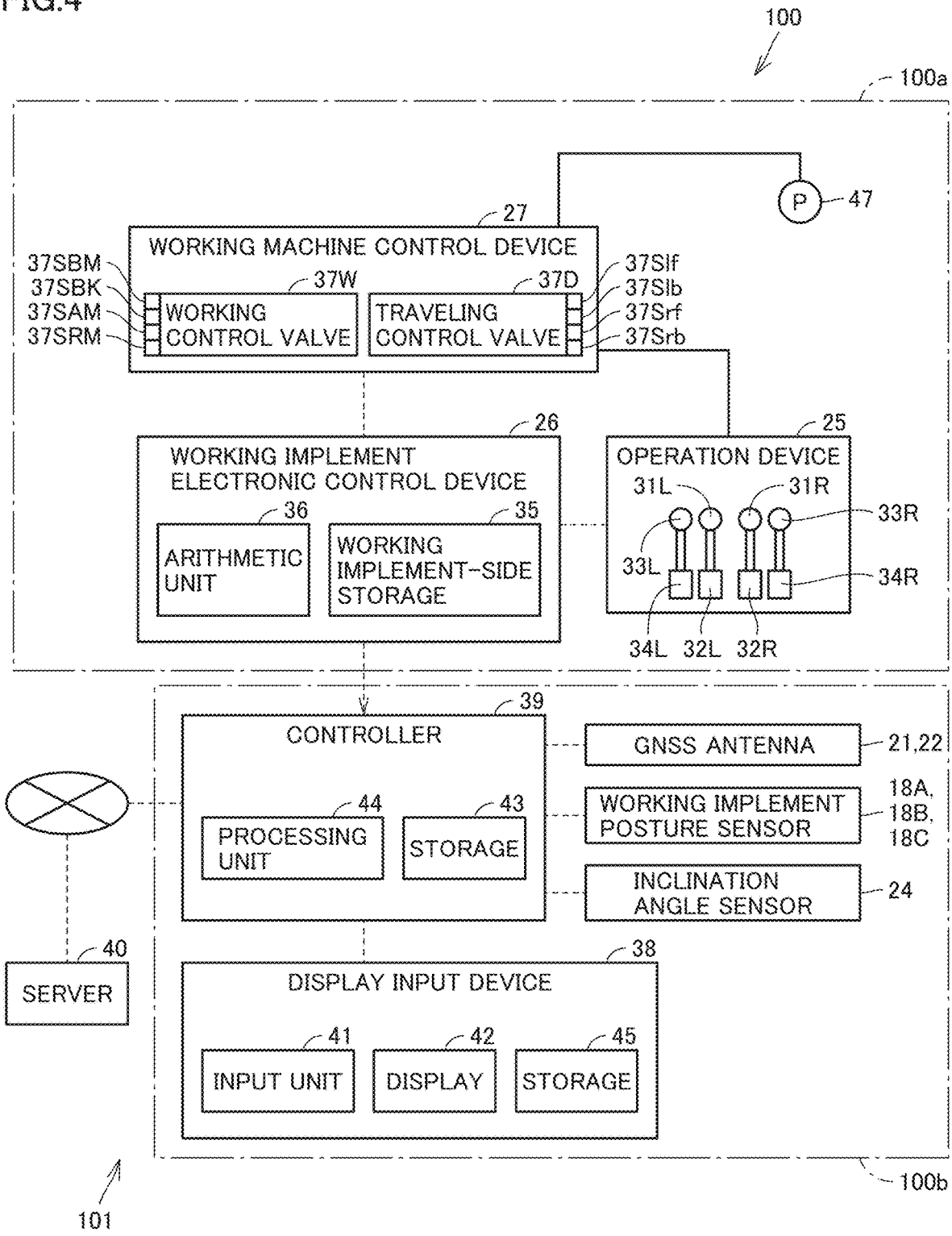
FIG. 4 is a block diagram illustrating a control system included in a display system of the embodiment.
Figure 5:
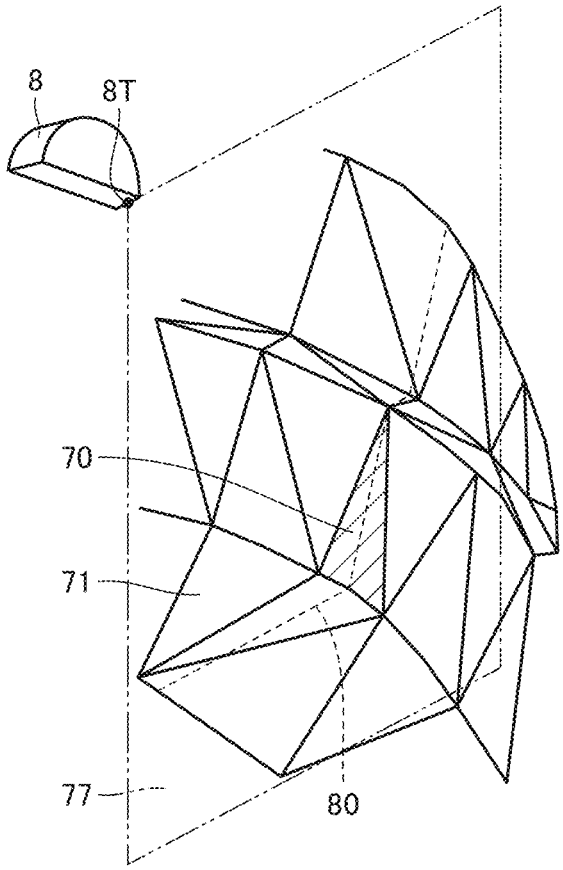
FIG. 5 is a view illustrating a construction topography and a target topography.

With reference to FIGS. 4 and 5, a display system of the embodiment will be described below. In the embodiment, the display system in the case where a retrofitted kit 100*b* is mounted on hydraulic excavator 100*a* later will be described as an example of the display system.

However, the display system of the present disclosure includes not only the case where retrofitted kit 100*b* is retrofitted to hydraulic excavator 100*a* after sale of hydraulic excavator 100*a*, but also the case where retrofitted kit 100*b* is mounted on hydraulic excavator 100*a* from the beginning of the sale of hydraulic excavator 100.

FIG. 4 is a block diagram illustrating a control system included in the display system of the embodiment. FIG. 5 is a view illustrating a construction topography and a target topography. As illustrated in FIG. 4, a display system 101 of the embodiment is a system that provides information constructing the construction topography in FIG. 5 for the operator during the excavation using hydraulic excavator 100, and supports the operation of the operator. Display system 101 includes hydraulic excavator 100*a*, retrofitted kit 100*b*, and a server 40.

Hydraulic excavator 100*a* includes operation device 25, a working implement electronic control device 26, a working machine control device 27, and a hydraulic pump 47.

Operation device 25 is a device that operates the operation of working implement 2 (FIG. 1) and the traveling of hydraulic excavator 100. Operation device 25 includes working implement operation members 31L, 31R, traveling operation members 33L, 33R, working implement operation detectors 32L, 32R, and traveling operation detectors 34L, 34R. For example, working implement operation members 31L, 31R and traveling operation members 33L, 33R are pilot-pressure type levers, but are not limited thereto. For example, working implement operation members 31L, 31R and traveling operation members 33L, 33R may be electric type levers.

Working implement operation detectors 32L, 32R function as operation detectors that detect inputs to working implement operation members 31L, 31R as operation units. Traveling operation detectors 34L, 34R function as operation detectors that detect inputs to traveling operation members 33L, 33R as operation units.

Working machine control device 27 is a hydraulic device including a hydraulic control valve and the like. Working machine control device 27 drives and controls boom cylinder 10, arm cylinder 11, bucket cylinder 12, a revolving motor, and hydraulic motor 5*c* based on the operation in operation device 25.

Working machine control device 27 includes a traveling control valve 37D and a working control valve 37W. For example, each of traveling control valve 37D and working control valve 37W is a proportional control valve. Traveling control valve 37D is controlled by the pilot pressure from traveling operation detectors 34L, 34R. Working control valve 37W is controlled by the pilot pressure from working implement operation detectors 32L, 32R.

Working machine control device 27 includes hydraulic sensors 37Slf, 37Slb, 37Srf, 37Srb. Each of hydraulic sensors 37Slf, 37Slb, 37Srf, 37Srb detects magnitude of the pilot pressure supplied to traveling control valve 37D and generates a corresponding electric signal. Hydraulic sensors 37Slf, 37Slb, 37Srf, and 37Srb function as operation detectors that detect inputs to traveling operation members 33L, 33R as operation units.

Hydraulic sensor 37Slf detects the pilot pressure for leftward forward movement. Hydraulic sensor 37Slb detects the pilot pressure for leftward backward movement. Hydraulic sensor 37Srf detects the pilot pressure for rightward forward movement. Hydraulic sensor 37Srb detects the pilot pressure for rightward backward movement.

When the operator operates traveling operation members 33L, 33R, the hydraulic oil having a flow rate corresponding to the pilot pressure generated in response to the operation flows out from traveling control valve 37D. The hydraulic oil flowing out of traveling control valve 37D is supplied to hydraulic motor 5*c* of traveling device 5. Thus, crawler belts 5*a*, 5*b* are rotationally driven.

Working machine control device 27 includes hydraulic sensors 37SBM, 37SBK, 37SAM, 37SRM. Each of hydraulic sensors 37SBM, 37SBK, 37SAM, 37SRM detects the magnitude of the pilot pressure supplied to working control valve 37W and generates a corresponding electric signal. Hydraulic sensors 37SBM, 37SBK, 37SAM, 37SRM function as operation detectors that detect inputs to working implement operation members 31L, 31R as operation units.

Hydraulic sensor 37SBM detects the pilot pressure corresponding to boom cylinder 10. Hydraulic sensor 37SAM detects the pilot pressure corresponding to arm cylinder 11. Hydraulic sensor 37SBK detects a pilot pressure corresponding to bucket cylinder 12. Hydraulic sensor 37SRM detects the pilot pressure corresponding to the revolving motor.

When the operator operates working implement operation members 31L, 31R, the hydraulic oil having a flow rate corresponding to the pilot pressure generated in response to the operation flows out of working control valve 37W. The hydraulic oil flowing out of working control valve 37W is supplied to at least one of boom cylinder 10, arm cylinder 11, bucket cylinder 12, and revolving motor. Thus, cylinders 10, 11, 12 expand and contract, and the revolving motor is revolved.

Working implement electronic control device 26 acquires the electric signal indicating the magnitude of the pilot pressure generated by working machine control device 27. Working implement electronic control device 26 controls the engine and the hydraulic pump based on the acquired electric signal. In addition, working implement electronic control device 26 outputs the acquired electric signal to controller 39 in order to generate the support image described later. For example, when the hydraulic sensors 37SBM, 37SBK, 37SAM are used as the working implement posture sensors, working implement electronic control device 26 outputs the acquired electric signals of hydraulic sensors 37SBM, 37SBK, 37SAM to controller 39. Controller 39 and working implement electronic control device 26 can communicate with each other by wireless or wired communication means.

Working implement operation members 31L, 31R and traveling operation members 33L, 33R may be electric type levers. In this case, working implement electronic control device 26 generates a control signal in order to operate working implement 2, revolving body 3, or traveling device 5 according to the operation of working implement operation members 31L, 31R or traveling operation members 33L, 33R, and outputs the control signal to working machine control device 27.

Working control valve 37W and traveling control valve 37D of working machine control device 27 are controlled based on the control signal from working implement electronic control device 26. The hydraulic oil having the flow rate according to the control signal from working implement electronic control device 26 flows out of working control valve 37W, and is supplied to at least one of boom cylinder 10, arm cylinder 11, and bucket cylinder 12. Consequently, working implement 2 operates. In addition, the hydraulic oil having the flow rate according to the control signal from working implement electronic control device 26 flows out from traveling control valve 37D and is supplied to hydraulic motor 5*c*. Consequently, traveling device 5 operates.

Working implement electronic control device 26 includes a working implement-side storage 35 including at least one of a random access memory (RAM) and a read only memory (ROM) and an arithmetic unit 36 such as a central processing unit (CPU). Working implement electronic control device 26 mainly controls the operations of working implement 2 and revolving body 3. Working implement-side storage 35 stores information such as a computer program controlling working implement 2.

Although working implement electronic control device 26 and controller 39 are separated from each other, the present invention is not limited to such the form. Working implement electronic control device 26 and controller 39 may be integrated without being separated.

Retrofitted kit 100*b* is mounted on hydraulic excavator 100 in order to implement display system 101. Retrofitted kit 100*b* includes IMUS 18A, 18B, 18C, GNSS antennas 21, 22, inclination angle sensor 24, display input device 38, and controller 39.

Controller 39 performs various functions of display system 101. Controller 39 includes a storage 43 and a processing unit 44. Storage 43 includes at least one of the RAM and the ROM. Processing unit 44 includes the CPU and the like.

Storage 43 stores working implement data. Working implement data includes a length L1 of boom 6, a length L2 of arm 7, a length L3 of bucket 8, and the like. When bucket 8 is replaced, a value corresponding to the size of replaced bucket 8 is input from input unit 41 and stored in storage 43 as length L3 of bucket 8 for working implement data.

The working implement data includes the minimum value and the maximum value of each of inclination angle θ1 of boom 6, inclination angle θ2 of arm 7, and inclination angle θ3 of bucket 8. Storage 43 stores an image display computer program, information about the coordinate of the machine body coordinate system, and the like.

The image display computer program may not be stored in storage 43 but may be stored in server 40. For example, server 40 is connected to controller 39 through the Internet line. In this case, in response to a request from the operator who operates hydraulic excavator 100, controller 39 accesses server 40 to execute the image display computer program stored in server 40. Then, the image as a result of the execution is displayed on a display 42 through the Internet line.

GNSS correction information may be transmitted from server 40 to controller 39 through the Internet line. Furthermore, a construction history by hydraulic excavator 100 may be transmitted from controller 39 to server 40 through the Internet line.

Storage 43 stores previously-prepared construction topography data. The construction topography data is information about the shape and position of the three-dimensional construction topography.

As illustrated in FIG. 5, the construction topography indicates a target shape of the ground that becomes a working target. The construction topography is constructed with a plurality of design surfaces 71 each of which is represented by a triangular polygon.

The working target is at least one of design surfaces 71. The operator selects at least one of design surfaces 71 as a target topography 70. Target topography 70 is a surface to be excavated from among the plurality of design surfaces 71. Target topography 70 indicates the target shape of a working target.

As illustrated in FIG. 4, processing unit 44 reads and executes the image display program stored in storage 43 or server 40. Thus, processing unit 44 causes display 42 to display the support screen.

Controller 39 acquires two reference position data P1, P2 (a plurality of pieces of reference position data) represented in the global coordinate system from GNSS antennas 21, 22. Controller 39 generates revolving body disposition data indicating the disposition of revolving body 3 based on two reference position data P1, P2.

Revolving body disposition data includes one reference position data P of two reference position data P1, P2 and revolving body orientation data Q generated based on two reference position data P1, P2. In revolving body orientation data Q, an orientation determined from reference position data P acquired by GNSS antennas 21, 22 is determined based on an angle relative to a reference orientation (for example, north) of a global coordinate.

Revolving body orientation data Q indicates the direction on which revolving body 3 faces (the orientation to which working implement 2 faces). Controller 39 updates the revolving body disposition data, namely, reference position data P and revolving body orientation data Q each time two reference position data P1, P2 are acquired from GNSS antennas 21, 22 at a frequency of, for example, 10 Hz.

Controller 39 acquires detection information about boom 6, arm 7, and bucket 8 from IMUS 18A, 18B, 18C. Controller 39 calculates the attitude of working implement 2 based on the detection information about IMUS 18A, 18B, 18C. Specifically, controller 39 calculates inclination angle θ1 of boom 6 based on the detection information about IMU 18A, calculates inclination angle θ2 of arm 7 based on the detection information about IMU 18B, and calculates inclination angle θ3 of bucket 8 based on the detection information about IMU 18C.

When hydraulic sensors 37SBM, 37SBK, 37SAM are used as the working implement posture sensors, working implement posture sensors 18A, 18B, 18C may be omitted from retrofitted kit 100*b*. When hydraulic sensors 37SBM, 37SBK, 37SAM are used as the working implement posture sensors, processing unit 44 of controller 39 calculates inclination angles θ1, θ2, θ3 based on the electric signals indicating the magnitudes of the pilot pressures detected by hydraulic sensors 37SBM, 37SBK, 37SAM.

Controller 39 acquires inclination information about machine body 1 from inclination angle sensor 24. As illustrated in FIG. 3, the inclination information is an inclination angle θ4 of the width direction of machine body 1 with respect to vertical direction Ng.

As described above, processing unit 44 of controller 39 can calculate the relative position of hydraulic excavator 100 with respect to the target topography and the posture of working implement 2. Thus, processing unit 44 can display information about the positional relationship between bucket 8 being excavated and the target topography, posture information guiding the operator to the operation of bucket 8, and the like on display 42.

Display input device 38 includes input unit 41, display 42, and storage 45. For example, input unit 41 is a button, a keyboard, a touch panel, or a combination thereof. For example, display 42 is a liquid crystal display (LCD) or an organic electro luminescence (EL) display. For example, storage 45 stores an application (software) reading and executing the image display computer program.

Display input device 38 is connected to controller 39 in a wireless or wired manner. Display input device 38 and controller 39 are wirelessly connected by, for example, Wi-Fi (registered trademark), BLUETOOTH (registered trademark), or Wi-SUN (registered trademark).

Display input device 38 may not be included in the above-described retrofitted kit. In this case, the user may substitute an own information portable terminal (smartphone, tablet, personal computer, and the like) as display input device 38. In addition, a display device existing in hydraulic excavator 100 may be substituted as display input device 38.

Display input device 38 displays the support screen providing information to the operator in order to perform the excavation using working implement 2. Also, various keys are displayed on the support screen. The operator can perform various functions of display system 101 by touching various keys on the support screen. The support screen will be described later.

<Support Screen>

Figure 6:
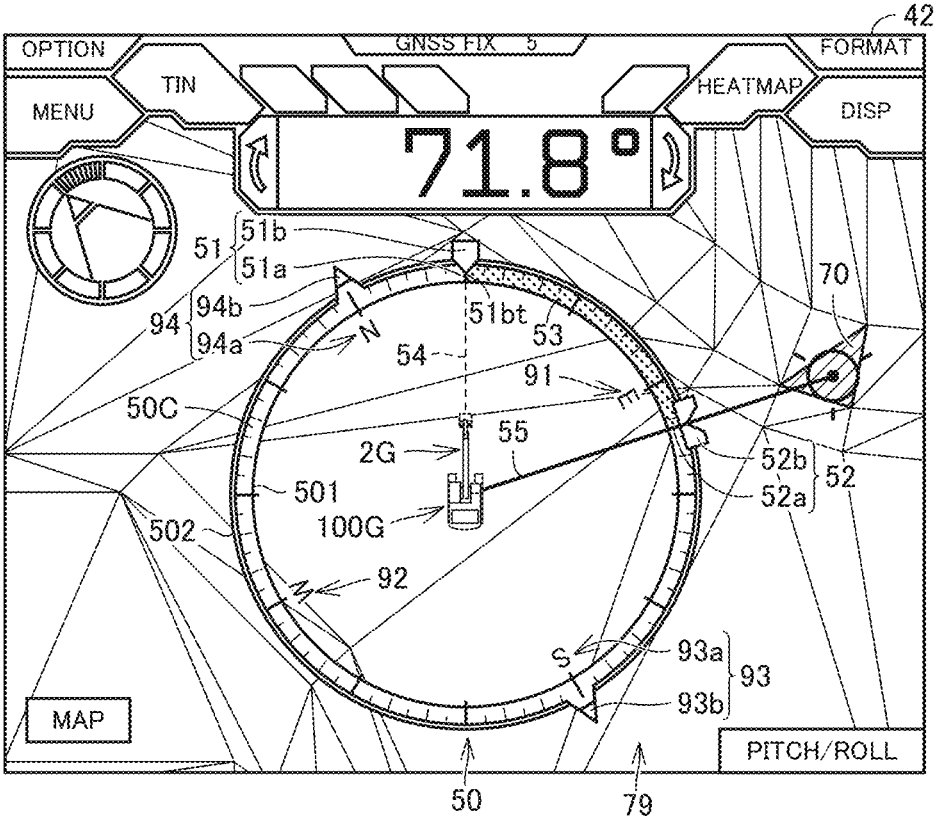
FIG. 6 is a view illustrating an image in which a support image is displayed with a hydraulic excavator 100 as a center in a top view of the hydraulic excavator as a first example of a support screen displayed on a display.
Figure 7:
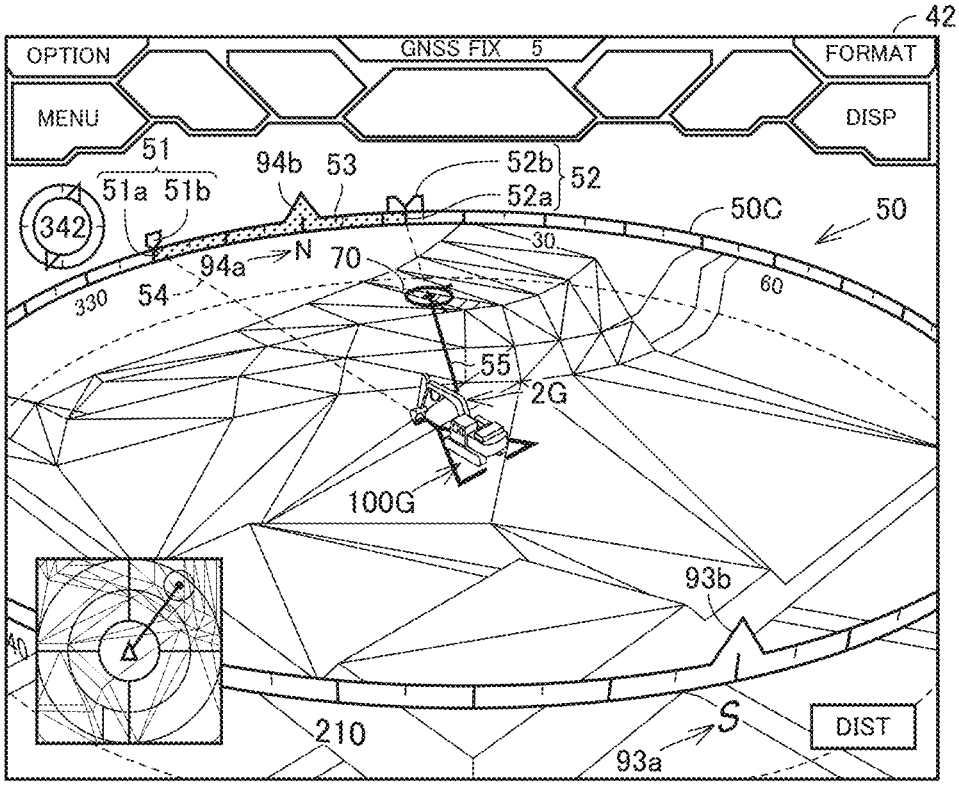
FIG. 7 is a view illustrating an image in which the support image is displayed with the hydraulic excavator 100 as a center in a bird's-eye view of the hydraulic excavator as a second example of the support screen displayed on the display.

With reference to FIGS. 6 and 7, first and second examples of the support screen displayed on display 42 in the display system of the embodiment will be described below.

FIG. 6 is a view illustrating an image in which a support image is displayed with hydraulic excavator 100 as a center in a top view of the hydraulic excavator as the first example of the support screen displayed on the display. FIG. 7 is a view illustrating an image in which the support image is displayed with hydraulic excavator 100 as a center in a bird's-eye view of the hydraulic excavator as the second example of the support screen displayed on the display.

As illustrated in FIG. 6, the first example of the support screen includes an image 100G (hereinafter, referred to as image 100G of the hydraulic excavator) illustrating hydraulic excavator 100, an image 79 of the construction topography including target topography 70, and a support image 50. Image 100G of the hydraulic excavator is an image of the top view of hydraulic excavator 100 (the image viewed from above the hydraulic excavator 100).

Controller 39 superimposes image 100G of the hydraulic excavator on the construction topography, and displays the superimposed image on display 42. Controller 39 displays image 100G of the hydraulic excavator on the construction topography based on the positional information indicating the current position of hydraulic excavator 100. Image 100G of the hydraulic excavator includes an image 2G (hereinafter, referred to as image 2G of the working implement) indicating working implement 2.

Controller 39 causes display 42 to display target topography 70 selected by the operator in the construction topography in a mode different from the construction topography that is not selected in the construction topography. For example, controller 39 changes a display color of the target topography from a default color. Thus, the operator can easily know the position of the target topography.

Controller 39 causes display 42 to display support image 50 while support image 50 is superimposed on the construction topography. Support image 50 includes a first FIG. 51 indicating the direction of working implement 2 (image 2G of the working implement), a second FIG. 52 indicating the direction of target topography 70 from hydraulic excavator 100 (image 100G of the hydraulic excavator), and a third FIG. 53 representing the relative relationship between first FIG. 51 and second FIG. 52. In this example, the direction of working implement 2 (image 2G of the working implement) is the direction of the neutral axis of working implement 2. The direction of working implement 2 is the direction from the attachment position of working implement 2 to bucket 8 in machine body 1.

As described above, because at least third FIG. 53 is displayed on display 42, according to display system 101, the operator can more easily visually understand the relationship between the direction of the working implement of hydraulic excavator 100 and the direction of the target topography from hydraulic excavator 100. According to display system 101, when the operator moves hydraulic excavator 100 in the direction of target topography 70, the direction of the working implement 2 can be guided for the operator so as to approach the direction of target topography 70.

For example, first FIG. 51 is both or one of a straight line 51*a* and a FIG. 51*b* having a home base shape (pentagonal shape). Straight line 51*a* is a straight line superimposed on a virtual straight line along the neutral axis of working implement 2. Straight line 51*a* is a straight line extended from bucket 8. A corner 51*bt* of FIG. 51*b* having the home base shape is located on the virtual straight line along the neutral axis of the working implement 2. FIG. 51*b* may have a polygonal shape such as a triangle or a circular shape such as a circle or an ellipse as long as the direction of working implement 2 of the hydraulic excavator 100 can be specified.

For example, second FIG. 52 is both or one of a straight line 52*a* and a FIG. 52*b*. Straight line 52*a* is a straight line superimposed on a straight line 55 connecting target topography 70 and image 100G of the hydraulic excavator. In this example, FIG. 52*b* has a shape in which two pentagons having line symmetry face each other.

The shape of FIG. 52*b* is not particularly limited as long as the direction of target topography 70 can be specified from hydraulic excavator 100, and may be a triangle, a polygon such as a home base, or a circular shape such as a circle or an ellipse.

The controller may display one of straight line 51*a* and FIG. 51*b* on display 42 as a FIG. indicating the direction of working implement 2 (image 2G of the working implement). Similarly, the controller may display any one of straight line 52*a* and FIG. 52*b* on display 42 as a FIG. indicating the direction of target topography 70 from hydraulic excavator 100 (image 100G of the hydraulic excavator).

Third FIG. 53 is a FIG. representing a relative relationship between first FIG. 51 and second FIG. 52. Third FIG. 53 is a FIG. connecting first FIG. 51 and second FIG. 52. Third FIG. 53 continuously connects first FIG. 51 and second FIG. 52 without interruption. For example, third FIG. 53 extends in a band shape and connects first FIG. 51 and second FIG. 52.

For example, support image 50 includes an annular FIG. 50C centered on a predetermined portion in the support screen. Annular FIG. 50C is displayed while being superimposed on the image 79 of the construction topography. Annular FIG. 50C includes an inner circumference 501 and an outer circumference 502. Annular FIG. 50C is an image in which a long belt is bent and rounded.

Straight line 51*a* of first FIG. 51 and straight line 52*a* of second FIG. 52 are illustrated in the belt of annular FIG. 50C. Each of straight line 51*a* and straight line 52*a* extends in the radial direction of the annular ring included in support image 50. In the band of annular FIG. 50C, corner 51*bt* of FIG. 51*b* having the home base shape and a part of FIG. 52*b* are located. Third FIG. 53 is illustrated in the belt of annular FIG. 50C. Third FIG. 53 has a belt-like arc shape connecting first FIG. 51 and second FIG. 52.

Controller 39 causes display 42 to display third FIG. 53 along a circle centered on the predetermined portion. Controller 39 causes display 42 to display third FIG. 53 along the annular FIG. 50C. Controller 39 causes display 42 to display third FIG. 53 along inner circumference 501 and outer circumference 502 of annular FIG. 50C.

Controller 39 causes display 42 to display annular FIG. 50C so as to surround the periphery of image 100G of the hydraulic excavator. Controller 39 causes display 42 to display inner circumference 501 of annular FIG. 50C so as to surround the periphery of image 100G of the hydraulic excavator. Controller 39 displays image 100G of the hydraulic excavator at the center of annular FIG. 50C. Controller 39 causes display 42 to display annular FIG. 50C such that the display position of image 100G of the hydraulic excavator is located at the center of annular FIG. 50C.

As described above, controller 39 causes display 42 to display third FIG. 53 along a circle (annular FIG. 50C, inner circumference 501, outer circumference 502) centered on image 100G of the hydraulic excavator. Thus, the operator can intuitively know how much the direction of working implement 2 should be changed.

As described above, controller 39 displays third FIG. 53 in an arc shape. Thus, the operator can easily know how much the direction of the working implement 2 should be changed by the arc shape (central angle).

A scale may be illustrated in the belt of the annulus included in support image 50. The scale extends in the radial direction in the belt of the annulus.

Controller 39 displays third FIG. 53 on display 42 by making a display mode of a part of annular FIG. 50C different from a display mode of another part. The arc-shaped portion in third FIG. 53 is colored differently from other portions in the belt of the annulus.

Controller 39 sets the color of third FIG. 53 to a color different from the default color of annular FIG. 50C. For example, the color of the arc shape in third FIG. 53 is red, and the color of other portions in the belt of the annulus is black. Thus, it is understood that the operator only needs to change the direction of working implement 2 by an angle corresponding to the proportion occupied by the portion of the color different from the default color in the region of annular FIG. 50C.

When the direction of working implement 2 changes due to the movement of working implement 2 or the traveling of hydraulic excavator 100, first FIG. 51 in support image 50 moves in the circumferential direction in the annular band. When the direction from hydraulic excavator 100 to target topography 70 changes due to the movement of working implement 2 or the traveling of hydraulic excavator 100, second FIG. 52 in support image 50 moves in the circumferential direction in the annular band.

As a result, the display of third FIG. 53 also changes. An area occupied by third FIG. 53 in annular FIG. 50C changes in real time. When visually recognizing support image 50, the operator can check the relationship between the direction of the working implement of hydraulic excavator 100 and the direction of the target topography from hydraulic excavator 100 in real time.

Support image 50 includes information indicating the orientation. The information includes images 91, 92, 93, 94 representing the orientations. Controller 39 causes display 42 to display images 91 to 94 along annular FIG. 50C. Thus, the operator can further know the direction of working implement 2, the direction from hydraulic excavator 100 to the target topography 70, and the like.

Image 91 indicates the direction of east. Hereinafter, images 92, 93, 94 indicate west, south, and north, respectively. Image 93 includes an image 93*a* representing a character "S" and a FIG. 93*b* protruding in the south direction. Image 94 includes an image 94*a* representing a character "N" and a FIG. 94*b* protruding in the north direction. In this example, controller 39 displays images 91, 92, 93*a*, 94*a* on the inner side of inner circumference 501.

Controller 39 causes display 42 to display a straight line 54 connecting first FIG. 51 and image 100G indicating hydraulic excavator 100 and a straight line 55 connecting second FIG. 52 and image 100G of the hydraulic excavator. Thus, the operator can more clearly recognize the difference between the direction of working implement 2 and the direction from hydraulic excavator 100 to target topography 70.

Controller 39 numerically displays an angle formed by the direction of working implement 2 (image 2G of the working implement) and the direction from hydraulic excavator 100 (image 100G of the hydraulic excavator) to target topography 70. Controller 39 displays the angle formed by straight line 54 and straight line 55 as a numerical value. Controller 39 displays the angle of the arc by third FIG. 53 as a numerical value while image 100G of the hydraulic excavator is set to the center of the arc. In the example of the state in FIG. 6, controller 30 displays "71.8°" above annular FIG. 50C as the numerical value. Such numerical information is also included in support image 50.

In the present example, support image 50 is displayed in top view similarly to image 79 of the construction topography and image 100G of the hydraulic excavator. Annular FIG. 50C, first FIG. 51, second FIG. 52, third FIG. 53, straight lines 54, 55, and images 91 to 94 are displayed as viewed from above. As illustrated, the support screen displayed on display 42 may include the facing compass at the position not overlapping with the support image 50 (for example, a corner of the screen such as the upper left of the screen).

As illustrated in FIG. 7, similarly to the first example, the second example of the support screen includes image 100G of the hydraulic excavator, image 79 of the construction topography including target topography 70, and support image 50. Image 100G of the hydraulic excavator is an image of hydraulic excavator 100 in a bird's eye view.

In this example, controller 39 displays image 79 of the construction topography and image 100G illustrating hydraulic excavator 100 in a bird's eye view. Controller 39 stereoscopically displays support image 50. Controller 39 displays annular FIG. 50C included in support image 50 in a three-dimensional shape. Controller 39 displays annular FIG. 50C on display 42 while annular FIG. 50C has a width in the vertical direction.

The operator can switch the screen between the top-view display (FIG. 6) and the bird's-eye view display by performing input on display 42. By switching the screen display on display 42 from the top view display to the bird's-eye view display, the operator can three-dimensionally grasp image 79 of the construction topography. According to the bird's-eye view display, when the operator moves hydraulic excavator 100 in the direction of target topography 70, the direction of working implement 2 can be guided in detail for the operator.

<Method for Generating Support Image>

Figure 8:
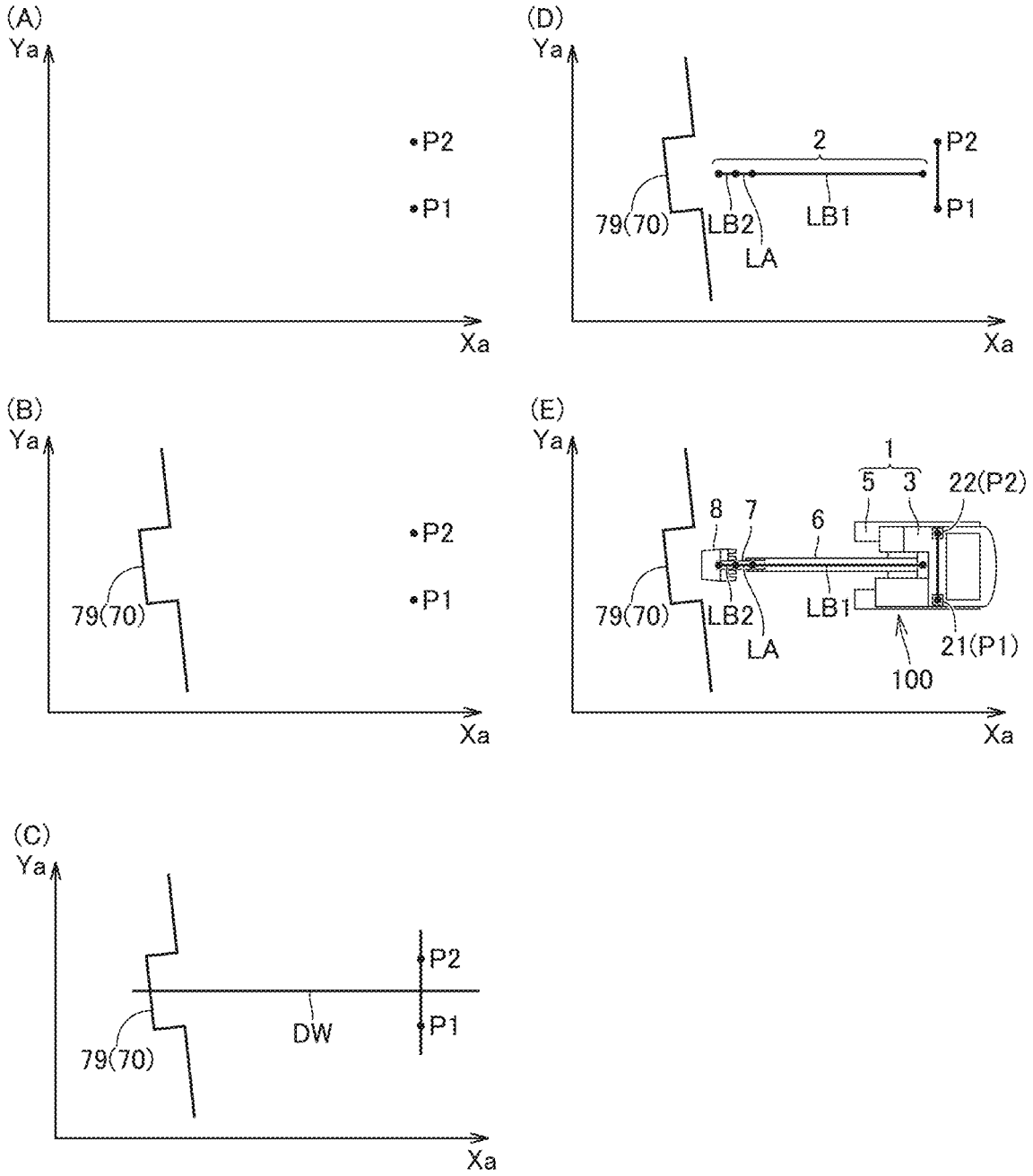
FIGS. 8(A) to 8(E) are views illustrating a method for generating the support image in order of steps.
Figure 9:
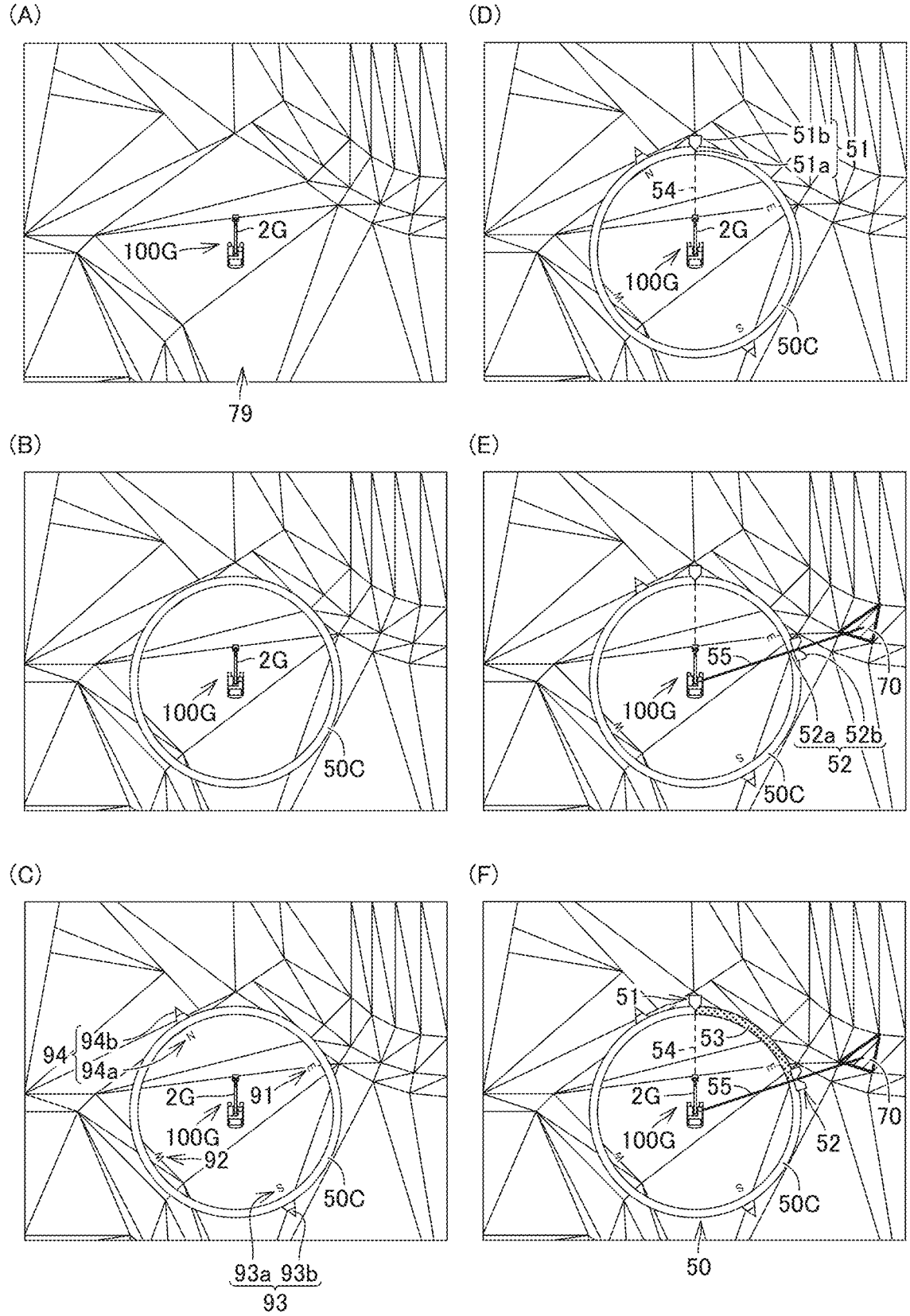
FIGS. 9(A) to 9(F) are views illustrating the method for generating the support image in a side view of the hydraulic excavator in the order of steps subsequent to the steps in FIG. 8.

With reference to FIGS. 8 and 9, a method for generating the first example of the support screen of the embodiment will be described below.

FIGS. 8(A) to 8(E) illustrate the method for generating the support image in order of steps. FIGS. 9(A) to 9(F) illustrate the method for generating the support image in top view of the hydraulic excavator in the order of steps subsequent to the steps in FIG. 8.

FIGS. 8(A) to 8(E) illustrate viewpoints when an Xa-Ya plane is viewed from the Za-axis direction, where the horizontal axis is the Xa-axis and the vertical axis is the Ya-axis.

As illustrated in FIG. 4, processing unit 44 of controller 39 reads and executes the image display program stored in storage 43 or server 40, generates the support screen, and displays the support screen on display 42. The reason is as follows.

As illustrated in FIG. 8(A), processing unit 44 of controller 39 acquires two reference position data P1, P2 (a plurality of reference position data) represented in the global coordinate system from GNSS antennas 21, 22. Processing unit 44 of controller 39 determines the position in the coordinate system based on one reference position data of two reference position data P1, P2. Thereafter, processing unit 44 of controller 39 determines which direction the line connecting the coordinates of two reference position data P1, P2 is directed with respect to the reference orientation (for example, north) of the global coordinate.

As illustrated in FIG. 8(B), processing unit 44 of controller 39 positions the construction topography with respect to reference position data P1, P2 in the coordinate system based on the reference position data and the determined orientation. At this point, processing unit 44 of controller 39 acquires the previously-produced construction topography data from storage 43 or server 40, and collates the shape and coordinates of the three-dimensional construction topography included in the construction topography data with the coordinates of reference position data P1, P2.

As illustrated in FIG. 8(C), processing unit 44 of controller 39 determines a direction DW of the operation plane of working implement 2 based on two reference position data P1, P2.

As illustrated in FIG. 8(D), processing unit 44 of controller 39 determines the posture of working implement 2. At this point, processing unit 44 of controller 39 acquires the postures of boom 6, 18A arm 7, and bucket 8 from working implement posture sensors 18A, 18B, 18C. Processing unit 44 of controller 39 determines a position LB1 of boom 6, a position LB2 of arm 7, and a position LA of bucket 8 based on the acquired posture of working implement 2.

As illustrated in FIG. 8(E), processing unit 44 of controller 39 disposes a 3D (dimension) model of hydraulic excavator 100 based on reference position data P1, P2 determined above, direction DW of the operation plane of working implement 2, the posture (θ1, θ2, θ3) of working implement 2, and the like. At this point, processing unit 44 of controller 39 acquires the 3D model of hydraulic excavator 100 stored in storage 43 or server 40.

As illustrated in FIG. 9(A), processing unit 44 of controller 39 produces image 100G of the hydraulic excavator in top view based on the 3D model obtained in FIG. 8(E). Image 100G of the hydraulic excavator includes image 2G of the working implement. In addition, processing unit 44 of controller 39 produces image 79 of the construction topography in top view.

As illustrated in FIG. 9(B), processing unit 44 of controller 39 generates annular FIG. 50C centered on a predetermined portion (for example, a mounting position of working implement 2 with respect to machine body 1) in image 100G of the hydraulic excavator in top view. Annular FIG. 50C is generated so as to surround the periphery of image 100G of the hydraulic excavator.

As illustrated in FIG. 9(C), processing unit 44 of controller 39 generates images 91, 92, 93, 94 representing the orientations in top view. Processing unit 44 generates images 91, 92, 93, 94 representing the orientations along annular FIG. 50C in top view.

As illustrated in FIG. 9(D), processing unit 44 of controller 39 generates first FIG. 51 indicating the direction of working implement 2 and straight line 54 extending the image of the bucket of working implement 2 in the direction of image 2G of the working implement in top view.

As illustrated in FIG. 9(E), when one topography (target topography 70) is selected from the construction topography by the operator, processing unit 44 of controller 39 generates second FIG. 52 indicating the direction of target topography 70 from image 100G of the hydraulic excavator in top view. Processing unit 44 displays the display state of target topography 70 so as to be distinguishable from the surrounding topography. For example, processing unit 44 changes the display color of the target topography from a default color to a specific color (for example, green).

As illustrated in FIG. 9(F), processing unit 44 of controller 39 generates third FIG. 53 representing the relative relationship between first FIG. 51 and second FIG. 52 in top view. Third FIG. 53 continuously connects first FIG. 51 and second FIG. 52 without interruption. For example, third FIG. 53 extends in a band shape and connects first FIG. 51 and second FIG. 52.

For example, third FIG. 53 is generated as the arc portion in the belt in annular FIG. 50C. For example, third FIG. 53 is generated in a color different from other arc portions in the belt in annular FIG. 50C.

When the direction of working implement 2 changes due to the movement of working implement 2 or the traveling of hydraulic excavator 100, first FIG. 51 in support image 50 moves in the circumferential direction in the annular band. When the direction from hydraulic excavator 100 to target topography 70 changes due to the movement of working implement 2 or the traveling of hydraulic excavator 100, second FIG. 52 in support image 50 moves in the circumferential direction in the annular band. Thus, the circumferential length of third FIG. 53 having the arc shape changes.

<Method for Controlling Display System>

Figure 10:
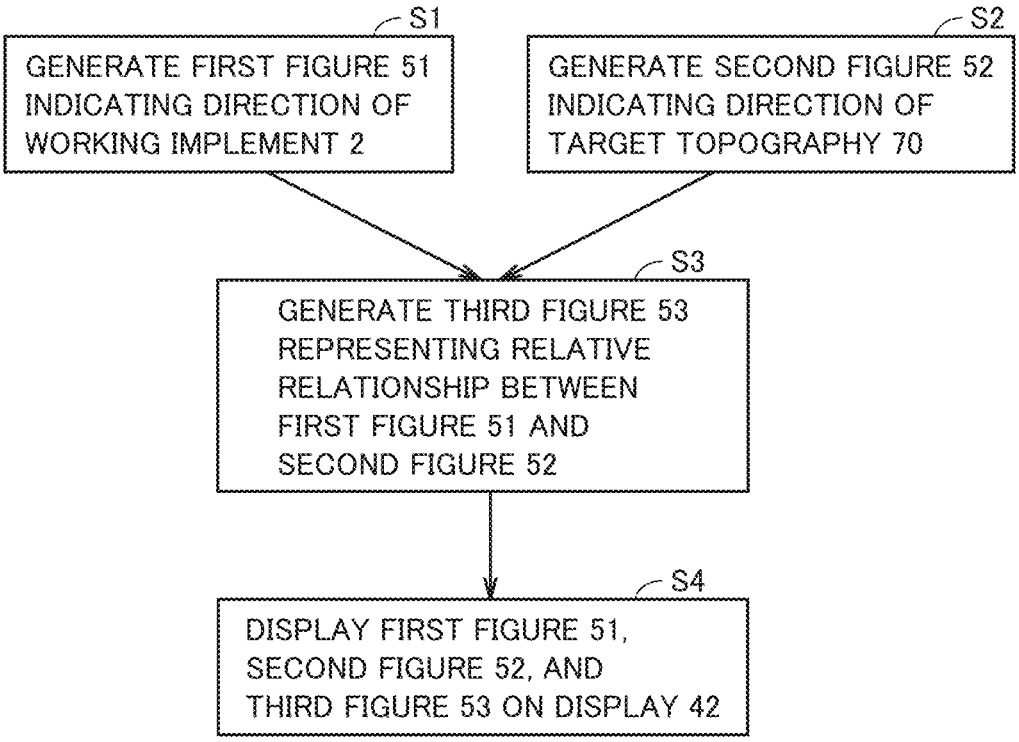
FIG. 10 is a flowchart illustrating a method for controlling the display system in the embodiment.

With reference to FIG. 10, a method for controlling the display system of the embodiment will be described below.

FIG. 10 is a flowchart illustrating the method for controlling the display system of the embodiment. As illustrated in FIG. 10, processing unit 44 of controller 39 generates first FIG. 51 indicating the direction of working implement 2 (step S1). Processing unit 44 of controller 39 generates first FIG. 51 as described with reference to FIG. 9(D).

Processing unit 44 of controller 39 generates second FIG. 52 indicating the direction of target topography 70 from hydraulic excavator 100 (step S2). Processing unit 44 of controller 39 generates second FIG. 52 as described with reference to FIG. 9(E).

Processing unit 44 of controller 39 generates third FIG. 53 representing the relative relationship between first FIG. 51 and second FIG. 52 (step S3). Processing unit 44 of controller 39 generates third FIG. 53 as described with reference to FIG. 9(F).

Processing unit 44 of controller 39 displays support image 50 including first FIG. 51, second FIG. 52, and third FIG. 53 on display 42 (step S4). As illustrated in FIG. 6 or 7, processing unit 44 of controller 39 displays support image 50 on display 42 together with image 100G of the hydraulic excavator, image 79 of the construction topography, and the like. Processing unit 44 of controller 39 switches between the display in FIG. 6 and the display in FIG. 7 based on the display switching operation by the operator.

<Modifications>

Figure 11:
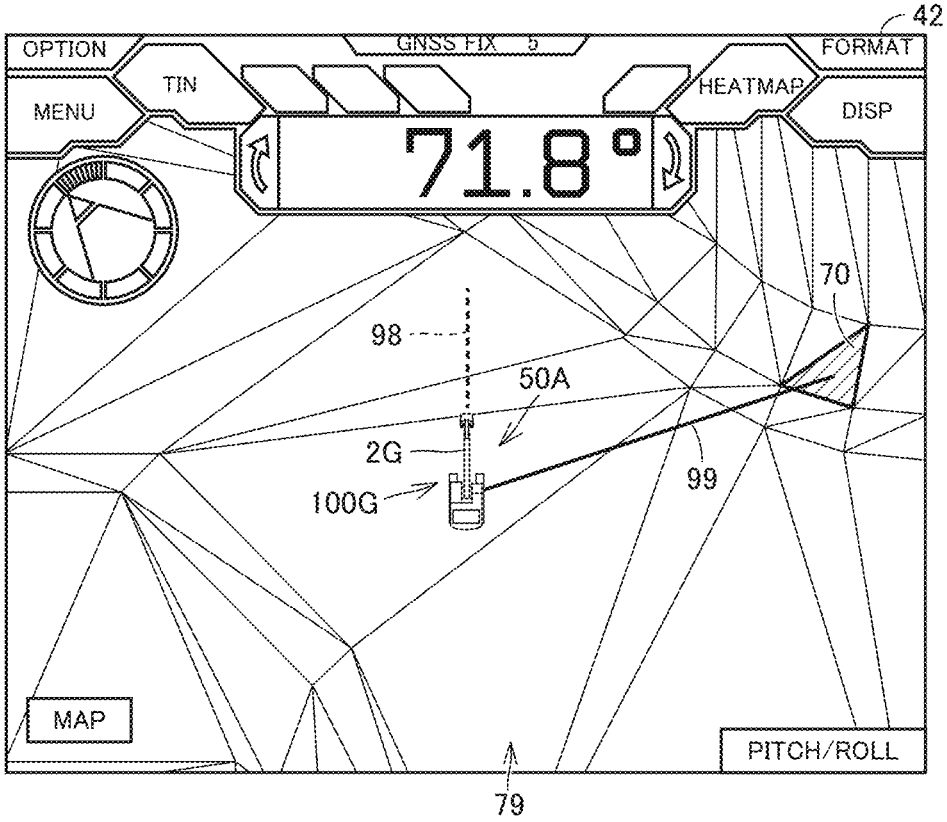
FIG. 11 is a view illustrating an image in which another support image is displayed with the hydraulic excavator as a center in the top view of the hydraulic excavator as a modification example of the support image displayed on the display.

With reference to FIG. 11, a modification of the display system of the embodiment will be described below.

FIG. 11 is a view illustrating an image in which another support image is displayed with hydraulic excavator 100 as a center in the top view of hydraulic excavator 100 as a modification example of the support image displayed on the display.

As illustrated in FIG. 11, controller 39 causes display 42 to display image 79 of the construction topography and image 100G illustrating hydraulic excavator 100. Controller 39 superimposes image 100G of the hydraulic excavator on image 79 of the construction topography and displays the superimposed image on display 42. Controller 39 displays image 100G of the hydraulic excavator 100 on image 79 of the construction topography based on the positional information indicating the current position of hydraulic excavator 100. Image 100G of the hydraulic excavator includes image 2G of the working implement.

Controller 39 causes display 42 to display target topography 70 selected by the operator in the construction topography in a mode different from the construction topography that is not selected in the construction topography.

Controller 39 causes display 42 to display support image 50A while support image 50A is superimposed on the construction topography. Support image 50A includes image 100G indicating hydraulic excavator 100, a straight line 98 extended from working implement 2 of hydraulic excavator 100, and a straight line 99 connecting the image indicating hydraulic excavator 100 and target topography 70. Straight line 98 is a straight line superimposed on the virtual straight line along the neutral axis of working implement 2. Straight line 98 is a straight line extended from bucket 8.

In such the display, according to display system 101, the operator can more easily visually understand the relationship between the direction of the working implement of hydraulic excavator 100 and the direction of the target topography from hydraulic excavator 100. According to such the display, when the operator moves hydraulic excavator 100 in the direction of target topography 70, the direction of working implement 2 can be guided for the operator.

The above embodiment is only by way of example, and the present invention is not limited to the above embodiment. The scope of the present invention is indicated by the claims, and it is intended that all modifications within the meaning and scope of the claims are included in the present invention.

REFERENCE SIGNS LIST

1: machine body, 2: working implement, 2G, 79, 91, 92, 93, 93*a*, 94, 94*a*, 100G: image, 3: revolving body, 4: operator cab, 4S: driver's seat, 5: traveling device, 6: boom, 7: arm, 8: bucket, 10: boom cylinder, 11: arm cylinder, 12: bucket cylinder, 13: boom pin, 14: arm pin, 15: bucket pin, 18A: working implement posture sensor, 21, 22: antenna, 24: inclination angle sensor, 25: operation device, 26: working implement electronic control device, 27: working machine control device, 35: working implement-side storage, 36: arithmetic unit, 38: display input apparatus, 39: controller, 40: server, 42: display, 43, 45: storage, 44: processing unit, 50, 50A: support image, 50C: annular FIG.,

51: first figure, 51*a*, 52*a*, 54, 55, 98, 99: straight line, 51*b*, 52*b*, 93*b*, 94*b*: FIG., 51*bt*: corner, 52: second figure, 53: third figure, 70: target topography, 71: design surface, 100: hydraulic excavator, 101: display system, 501: inner circumference, 502: outer circumference

The invention claimed is:

1. A display system comprising:

a display; and a controller that causes the display to display a third figure representing a relative relationship between a first figure and a second figure, the first figure indicating a direction of a working implement of a working machine, and the second figure indicating a direction from the working machine to a target topography and moving along an annular figure when the direction from the working machine to the target topography changes due to traveling of the working machine.

2. The display system according to claim 1, wherein the controller causes the display to display the third figure along the annular figure.

3. The display system according to claim 2, wherein the controller causes the display to display an image indicating the working machine together with the third figure.

4. The display system according to claim 3, wherein the image indicating the working machine is displayed at a central portion of the annular figure.

5. The display system according to claim 4, wherein the controller causes the display to display the annular FIG. so as to surround a periphery of the image of the working machine.

6. The display system according to claim 5, wherein the controller displays an image representing an orientation along the annular FIG. on the display.

7. The display system according to claim 3, wherein the controller causes the display to display a first straight line connecting the first figure and the image indicating the working machine and a second straight line connecting the second figure and the image indicating the working machine.

8. The display system according to claim 3, wherein the controller further displays, on the display, an image representing a construction topography including a target topography, together with the third figure and the image indicating the working machine.

9. The display system according to claim 8, wherein the controller displays, on the display, an image representing the target topography and an image representing a construction topography that is not selected in the construction topographies, in different modes.

10. The display system according to claim 1, wherein the controller displays, on the display, at least one of the first figure and the second figure together with the third figure.

11. The display system according to claim 4, wherein the controller displays the third figure and the image indicating the working machine in top view.

12. The display system according to claim 4, wherein the controller displays the third figure and the image indicating the working machine in a bird's eye view.

13. The display system according to claim 1, wherein the working machine is an excavator, the working implement includes a bucket, and the direction of the working implement is a direction from a main body of the excavator to the bucket.

14. A display system comprising:

a display; and a controller that causes the display to display a third figure along an annular FIG., the third figure representing a relative relationship between a first figure indicating a direction of a work implement of a working machine and a second figure indicating a direction from the working machine to a target terrain, wherein the controller further causes the display to display, together with the third figure, an image indicating the working machine, a straight line extended from a working implement of the working machine, a first straight line connecting the first figure and the image indicating the working machine, and second straight line connecting the second FIG. and the image indicating the working machine.

15. A non-transitory computer readable medium storing a program that causes a processor of a controller to execute:

generating a first figure indicating a direction of a working implement of a working machine;

generating a second figure indicating a direction from the working machine to a target topography and moving along an annular FIG. when the direction from the working machine to the target topography changes due to traveling of the working machine;

generating a third figure representing a relative relationship between the first figure and the second figure; and causing a display to display at least the second figure and third figure from among the first figure, the second figure, and the third figure.

16. A display control method comprising:

generating a first figure indicating a direction of a working implement of a working machine;

generating a second figure indicating a direction from the working machine to a target topography and moving along an annular FIG. when the direction from the working machine to the target topography changes due to traveling of the working machine;

generating a third figure representing a relative relationship between the first figure and the second figure; and displaying at least the second figure and third figure from among the first figure, the second figure, and the third figure on a display.

* * * * *